United States Patent [19]

Slay

[11] Patent Number: 4,718,126

[45] Date of Patent: Jan. 12, 1988

[54] FLASHLIGHT HOLDING APPARATUS

[76] Inventor: Ronald P. Slay, 7602 Croton St., Houston, Tex. 77036

[21] Appl. No.: 917,775

[22] Filed: Oct. 10, 1986

[51] Int. Cl.[4] ..... A42B 1/18

[52] U.S. Cl. ..... 2/175; 362/105; 2/DIG. 6

[58] Field of Search ..... 2/209.2, 109, 160, 175, 2/185, DIG. 6, DIG. 11; 362/105, 106, 341; 224/250

[56] References Cited

U.S. PATENT DOCUMENTS

| | | | |
|---|---|---|---|
| 3,542,041 | 11/1970 | Mercorella | 2/DIG. 6 |
| 4,236,658 | 12/1980 | Kallman | 2/DIG. 6 |
| 4,462,068 | 7/1984 | Schweitzer | 362/105 |

FOREIGN PATENT DOCUMENTS

| | | | |
|---|---|---|---|
| 369448 | 3/1932 | United Kingdom | 362/105 |

*Primary Examiner*—Doris L. Troutman

*Attorney, Agent, or Firm*—Dula, Shields & Egbert

[57] ABSTRACT

An apparatus for holding a flashlight comprising a first strap, a second strap affixed to one end of the first strap, and a section of elastic material affixed to the second strap and arranged so as to define a hole between the second strap and the section of elastic material. The other end of the second strap is removably attachable to a portion of the first strap. The first strap and the second strap are longitudinally aligned. The longitudinal axis of the hole is aligned with the first strap and the second strap. The hole has an expandable size suitable for receiving the outer diameter of a flashlight.

3 Claims, 5 Drawing Figures

FLASHLIGHT HOLDING APPARATUS

TECHNICAL FIELD

The present invention relates to devices that support light sources. More particularly, the present invention relates to devices that position flashlights about the body of a human being.

BACKGROUND ART

Flashlights are well-known devices for the portable transportation of light. Flashlights are often used to explore dark environments, to focus light on a particular object, and to provide viewing ability at night.

It is also well known that coal miners have used lamps affixed to helmets. These coal miner lamps enable the coal miner to freely use both of his hands while working. If the miner were forced to use a flashlight, then only one hand would be available for working.

Apparatus such as the devices used by coal miners are often cumbersome and quite expensive. The apparatus used to support the light on one's head is often weightly, uncomfortable, and not conveniently storable. It has been a problem in the past that campers, hikers, hunters, and other recreational users of the outdoors, have had difficulty in controlling a flashlight while attempting to perform two-handed operations. Typically, one must place the flashlight in one's mouth in order to direct light on the desired work.

It is an object of the present invention to provide an apparatus that permits a person to attach a flashlight to his head, or other portion of his body.

It is another object of the present invention to provide a flashlight holding apparatus that is inexpensive to manufacture.

It is a further object of the present invention to provide a flashlight holding apparatus that is adaptable to a wide range of head sizes.

It is still a further object of the present invention to provide a flashlight holding apparatus that is lightweight, small in size, compactible, and convenient.

These and other objects of the present invention will become apparent from a reading of the attached specification and appended claims.

DISCLOSURE OF THE INVENTION

The present invention is an apparatus for holding a flashlight about a portion of the body of a human being that comprises a first strap, a second strap attached to one end of the first strap, and a section of elastic material affixed to the second section. The elastic material defines a hole which accommodates the outer diameter of a flashlight. This hole has a longitudinal axis that is aligned with the first and second straps.

The first strap is a section of hook-type material. The hook-type material is arranged on one side of the first strap.

The second strap has a surface of loop-type material. This loop-type material extends generally through the entire length and on one side of the second strap. The loop-type material of the second strap is removably attachable to a portion of the first strap when the first and second straps are wrapped around the head of a human. The first and second straps are longitudinally aligned.

The section of elastic material is affixed to the second strap by sewing or other means. The elastic material is a length of elastic having ends fastened together. This length of elastic material wraps around the surfaces of the second strap. The length of the elastic material is transverse to the length of the second strap. The hole defined by the elastic material is expandable so as to receive the outer diameter of a flashlight and to affix the flashlight in proper position.

BEST MODE FOR CARRYING OUT THE INVENTION

Figure 1:
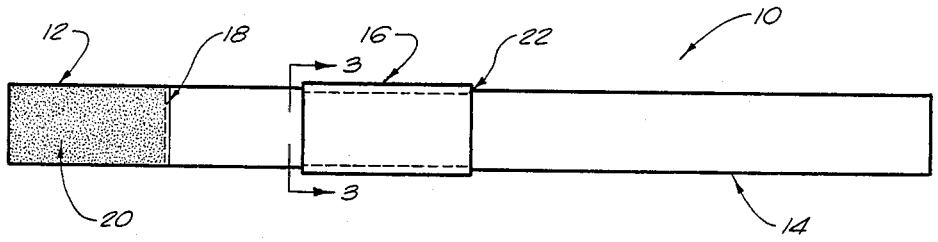
FIG. 1 is a view in side elevation of one side of the flashlight holding apparatus of the present invention.

Referring to FIG. 1, there is shown at 10 the flashlight holding apparatus in accordance with the preferred embodiment of the present invention. Flashlight holding apparatus 10 comprises a first strap 12, a second strap 14 and a section of elastic material 16. First strap 12 is attached at 18 to one end of second strap 14. Elastic section 16 is affixed to second strap 14.

First strap 12 is a section of hook-type material. This hook-type material is commonly known as VELCRO TM. First strap 12 has a length of approximately four inches. The hook-type material of first strap 12 occurs on only one surface of strap 12. The length of strap 12 is configured to accommodate the various sizes of human heads.

As can be seen in FIG. 1, first strap 12 is sewed to one end of second strap 14. The stitches of the sewing 18 extend transverse to the longitudinal axis of the longitudinally aligned straps 12 and 14. Although sewing is described in connection with the preferred embodiment of the present invention, various other methods of attaching first strap 12 to second strap 14 may be utilized to accomplish the purposes of the present invention. It may be possible, and preferable, to attach the straps by sonic welding, fusing, stapling, gluing, or tacking.

As can be seen in FIG. 1, the section of elastic material 16 is affixed to second strap 14. The section of elastic material 16 may also be made of elastomeric material. As shown in FIG. 1, elastic material 16 is attached by sewing to second strap 14. The stitches 22 and 24 of this sewing extend longitudinally along second strap 14. As shown in FIG. 1, second strap 14 has a smooth surface.

Figure 2:
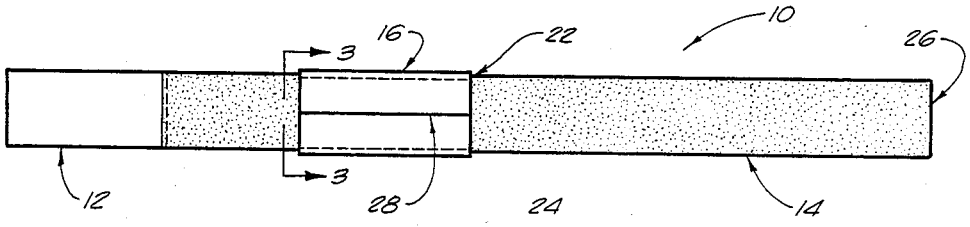
FIG. 2 is a view in side elevation of the opposite side of FIG. 1 of the flashlight holding apparatus of the present invention.

FIG. 2 shows the opposite side of the flashlight holding device 10 of FIG. 1. In FIG. 2, first strap 12 has a smooth surface on the side opposite the hook-type material 20. Second strap 14 is shown as having a surface of loop-type material, otherwise known as VELCRO TM. This loop-type material extends along the entire length of strap 14. When in use, the end 26 of second strap 14 will wrap around a human head and engage the hook-type material 20 of first strap 12. In this manner, the flashlight holding apparatus 10 adjustably fits the human head, or other portion of the body. Second strap 14 may also be made of a length of elasticized VELCRO TM, otherwise known as VELSTRETCH TM.

Elasticized VELCRO TM will allow the straps 12 and 14 to adjustably fit human heads. This elasticized VELCRO TM will also enable the other ends of straps 12 and 14 to be semi-permanently joined.

In FIG. 2, the opposite side of the section of elastic material 16 is shown. The elastic material 16 is a length of an elastic or an elastomer that has its ends attached, by sewing, at 28. In this step of sewing, the ends of elastic section 16 are curled inwardly toward the second strap 14. Since the ends of the elastic 16 are frayed, it is desirable to sew the ends together at a small distance from the ends of the material. This prevents the frayed ends of the elastic from being exposed. This helps to prevent the unravelling and unsightly appearance of the elastic.

As can be seen in FIGS. 1 and 2, the sewing extends through both sides of second strap 14 and securely attaches the elastic material 16 to the strap 14.

Figure 3:
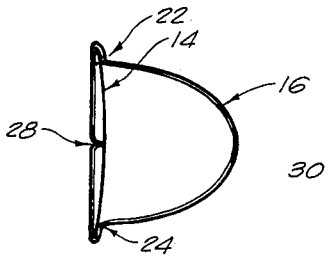
FIG. 3 is a view of the present invention taken along lines 3—3 of FIGS. 1 and 2.

FIG. 3 shows the configuration of the elastic section 16 with respect to the second strap 14. As can be seen the sewing 22 and 24 causes the elastic section 16 to be attached to both sides of strap 14. Similarly, it is shown that the ends 28 of elastic section 16 are drawn together inwardly toward second strap 14. Importantly, the elastic section 16 defines a hole 30 between sewed areas 22 and 24. Hole 30 has an expandable size suitable for receiving the outer diameter of a flashlight. Ideally, hole 30 in its unexpanded state, is smaller than the outer diameter of a flashlight. The elastic will expand, fit over the outer diameter of a flashlight, and retain the flashlight in secure position.

Figure 4:
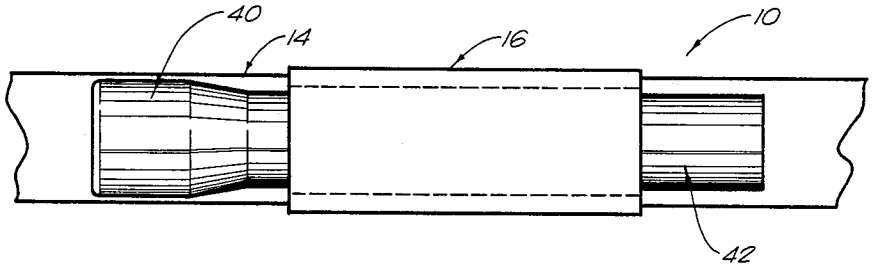
FIG. 4 is a side view showing the flashlight holding apparatus as a accommodating a flashlight.

FIG. 4 shows the flashlight 40 as accommodated by the flashlight holding apparatus 10. Flashlight 40 is, ideally, one of the new type of high-powered miniature flashlights, such as MAGLITE TM. This type of flashlight is relatively lightweight and can be maintained about the head with minimal discomfort. In FIG. 4, the barrel of 42 of flashlight 40 is received by the hole defined by elastic section 16. Second strap 14 is adjacent the side of flashlight 40.

Figure 5:
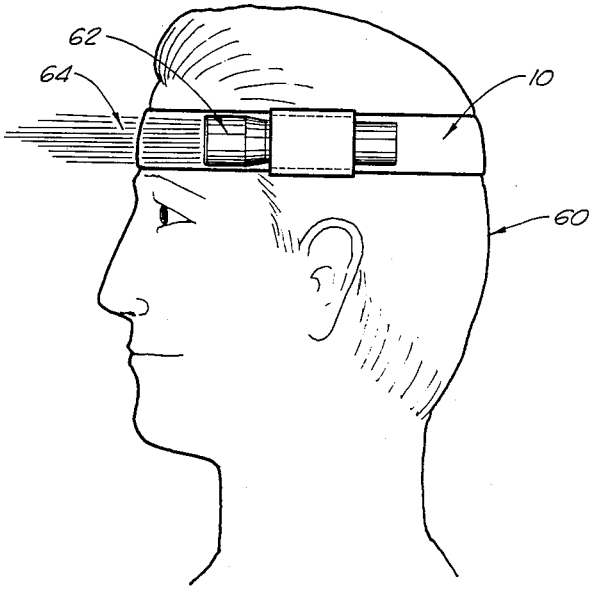
FIG. 5 shows the present invention as attached to a human body.

FIG. 5 shows the flashlight holding apparatus of the present invention in use. In FIG. 5, human 60 has wrapped the flashlight holding appparatus 10 about his head. The flashlight 62 is arranged so as to direct light 64 outwardly in the direction of the eyesight of the person 60. Flashlight holding apparatus 10 can be easily rotated about the head to place the light and direct the light as desired. In use, the softer, loop-type material is juxtaposed against the head of person 60. The rougher, hook-type material is on the opposite side of the strap from the person's head. As such, the present invention maintains a modicum of comfort for the user.

The present invention offers a number of advantages not found in other devices. Most importantly, the present invention allows the user to keep both hands free while directing light to the object of the work. Since the light is aligned with the eyesight of the person, the person is not required to contort greatly to accomplish the work. The flashlight holding apparatus is extremely light. The strap can be easily compacted, compressed, or stored in a small area. This is ideal for backpackers and others that desire to minimize loads.

It should be also be kept in mind that the present invention can be wrapped around the legs and/or arms of a person. As such, the apparatus of the present invention can be used where head gear prohibits the wrapping of the apparatus about the head.

The foregoing disclosure and description of the invention is illustrative and explanatory thereof, and various changes in the size, shape, and materials, as well as in the details of the illustrated construction, may be made within the scope of the appended claims without departing from the spirit of the invention. This invention should only be limited by the appended claims and their legal equivalents.

I claim:

1. An apparatus for holding a flashlight comprising:

a first strap having one surface of hook-type material;

a second strap affixed to one end of said first strap, the other end of said second strap removably attachable to a portion of said first strap, said first strap and said second strap being longitudinally aligned, said second strap having one surface of loop-type material, said surface of loop-type material being on the side of said second strap opposite said hook-type material of said first strap, said second strap being of plasticized material, said first strap having one end sewed to said second strap; and a section of elastic material affixed to said second section such that a hole is defined by the surfaces of said section of elastic material and of said second strap, said hole having a longitudinal axis aligned with said first strap and said second strap, said hole having an expandable size suitable for receiving the outer diameter of a flashlight, the length of said elastic material being generally transverse to the length of said first and second straps, the ends of said length of said elastic material being sewed together, said length of elastic material encircling said second strap, said section of elastic material being sewed to said second strap, said length of elastic material having a width smaller than the length of a flashlight.

2. The apparatus of claim 1, said first and second sections having a combined length at least as long as the largest circumference of human heads.

3. The apparatus of claim 1, said loop-type material of said second strap engaging the hook-type material of said first strap when said first and second straps are wrapped around a human head.

* * * * *